US006079065A

United States Patent [19]

Luff et al.

[11] Patent Number: 6,079,065

[45] Date of Patent: Jun. 27, 2000

[54] BED ASSEMBLY WITH AN AIR MATTRESS AND CONTROLLER

[75] Inventors: Lawrence E. Luff; Steven R. Westerfeld, both of Batesville; Ryan A. Reeder, Brookville, all of Ind.

[73] Assignee: PaTMarK Company, Inc., Wilmington, Del.

[21] Appl. No.: 09/064,272

[22] Filed: Apr. 22, 1998

[51] Int. Cl.[7] ..... A47B 7/02; A47C 27/08

[52] U.S. Cl. ..... 5/618; 5/613; 5/616; 5/710; 5/713

[58] Field of Search ..... 5/618, 617, 613, 5/616, 710, 713

[56] References Cited

U.S. PATENT DOCUMENTS

| | | | |
|---|---|---|---|
| 2,996,732 | 8/1961 | Draper | 5/616 |
| 3,921,230 | 11/1975 | Hanning et al. | 5/616 |
| 4,066,072 | 1/1978 | Cummins . | |
| 4,224,706 | 9/1980 | Young et al. . | |
| 4,231,019 | 10/1980 | Junginger et al. . | |
| 4,306,322 | 12/1981 | Young et al. . | |
| 4,394,784 | 7/1983 | Swenson et al. . | |
| 4,435,862 | 3/1984 | Callaway . | |
| 4,542,547 | 9/1985 | Sato . | |
| 4,679,264 | 7/1987 | Mollura . | |
| 4,686,722 | 8/1987 | Swart . | |
| 4,745,647 | 5/1988 | Goodwin . | |
| 4,787,104 | 11/1988 | Grantham . | |
| 4,797,962 | 1/1989 | Goode . | |
| 4,829,616 | 5/1989 | Walker . | |
| 4,839,932 | 6/1989 | Williamson | 5/618 X |
| 4,890,344 | 1/1990 | Walker . | |
| 4,897,890 | 2/1990 | Walker . | |
| 4,944,060 | 7/1990 | Peery et al. . | |
| 4,949,412 | 8/1990 | Goode . | |
| 4,982,466 | 1/1991 | Higgins et al. . | |
| 4,986,738 | 1/1991 | Kawasaki et al. . | |
| 4,995,124 | 2/1991 | Wridge, Jr. et al. . | |
| 4,999,867 | 3/1991 | Toivio et al. . | |
| 5,020,176 | 6/1991 | Dotson . | |
| 5,035,016 | 7/1991 | Mori et al. . | |
| 5,044,029 | 9/1991 | Vrzalik . | |
| 5,062,167 | 11/1991 | Thomas et al. . | |
| 5,062,169 | 11/1991 | Kennedy et al. . | |
| 5,073,999 | 12/1991 | Thomas et al. . | |
| 5,090,077 | 2/1992 | Caden et al. . | |
| 5,105,488 | 4/1992 | Hutchinson et al. . | |
| 5,129,115 | 7/1992 | Higgins et al. . | |
| 5,142,717 | 9/1992 | Everard et al. . | |
| 5,509,154 | 4/1996 | Shafer et al. . | |
| 5,544,376 | 8/1996 | Fromson | 5/618 |
| 5,652,484 | 7/1997 | Shafer et al. . | |
| 5,829,077 | 11/1998 | Neige | 5/617 X |
| 5,870,784 | 2/1999 | Elliott | 5/618 |

FOREIGN PATENT DOCUMENTS

| | | |
|---|---|---|
| 1 178 719 | 11/1984 | Canada . |
| 1 224 888 | 7/1987 | Canada . |
| 0 178 951 | 4/1986 | European Pat. Off. . |
| 0 220 708 | 5/1987 | European Pat. Off. . |
| 0 228 233 | 7/1987 | European Pat. Off. . |
| 0 261 830 | 3/1988 | European Pat. Off. . |
| 0 302 579 | 2/1989 | European Pat. Off. . |
| 0 341 570 | 11/1989 | European Pat. Off. . |
| 0 453 363 | 10/1991 | European Pat. Off. . |
| 4-322611 | 11/1992 | Japan . |
| WO 96/13947 | 5/1996 | WIPO . |

*Primary Examiner*—Terry Lee Melius
*Assistant Examiner*—Rodrigo J. Morales
*Attorney, Agent, or Firm*—Barnes & Thornburg

[57] ABSTRACT

A bed assembly has a frame with at least one articulated frame section and a drive system for moving the articulated frame section. The drive system includes a first electrical circuit and a remote control unit that sends command signals to the first electrical circuit. The bed further includes a mattress having at least one air bladder and a controller including a compressor fluidly coupled to the at least one air bladder. The controller includes a second electrical circuit that couples to the first electric circuit so that at least one of the command signals received from the remote control unit is communicated to the second electrical circuit via the first electrical circuit.

16 Claims, 4 Drawing Sheets

BED ASSEMBLY WITH AN AIR MATTRESS AND CONTROLLER

BACKGROUND AND SUMMARY OF THE INVENTION

The present invention relates to a bed assembly and particularly, to a bed assembly with an air mattress and controller. More particularly, the present invention relates to a bed assembly having electrical and pneumatic circuitry to control the pressure within an air bladder of the air mattress.

Bed assemblies including mattresses having inflatable air bladders are known. Some mattresses having air bladders are used in hospitals to support patients requiring long term care and some mattresses having air bladders are used by consumers at home. Inflation of air mattresses may be accomplished by a fairly sophisticated control system having sensors that sense air pressure within one or more air bladders of the air mattress and having one or more microprocessors that control other components of the control system based on the pressure sensed by the sensors. Many conventional beds with air mattresses also include articulating frame sections that are moved to adjust the position of a patient supported by the mattress. The position of the articulated frame sections is sometimes controlled by yet another sophisticated control system. Consumers would welcome an economical bed assembly that may be purchased, initially, without an air mattress, and that may be upgraded, later, to include an air mattress.

According to the present invention, a bed includes a frame having at least one articulated frame section and a drive system for moving the articulated frame section. The drive system includes a first electrical circuit and a remote control unit that sends command signals to the first electrical circuit. The bed further includes a mattress having at least one air bladder and a controller including a compressor fluidly coupled to the at least one air bladder. The controller includes a second electrical circuit that couples to the first electric circuit so that at least one of the command signals received from the remote control unit is communicated to the second electrical circuit from the first electrical circuit.

In illustrated embodiments, the first electric circuit includes an RF module and the remote control unit is a hand-held, wireless remote control. In addition, the control unit includes at least one solenoid valve that moves in response to signals transmitted from the remote control. The control system of one illustrated embodiment does not include a microprocessor or pressure sensors thereby allowing the cost of the air control system to be less than prior art air control systems that include such components. The remote control includes a first button that is pressed to further inflate the air bladders and a second button that is pressed to further deflate the air bladders. A user presses the first and second buttons to adjust the firmness of the air bladders while lying on the mattress. Thus, according to one embodiment of the present invention, the user adjusts the firmness level of the mattress until the mattress "feels" comfortable to the user.

Additional features and advantages of the present invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
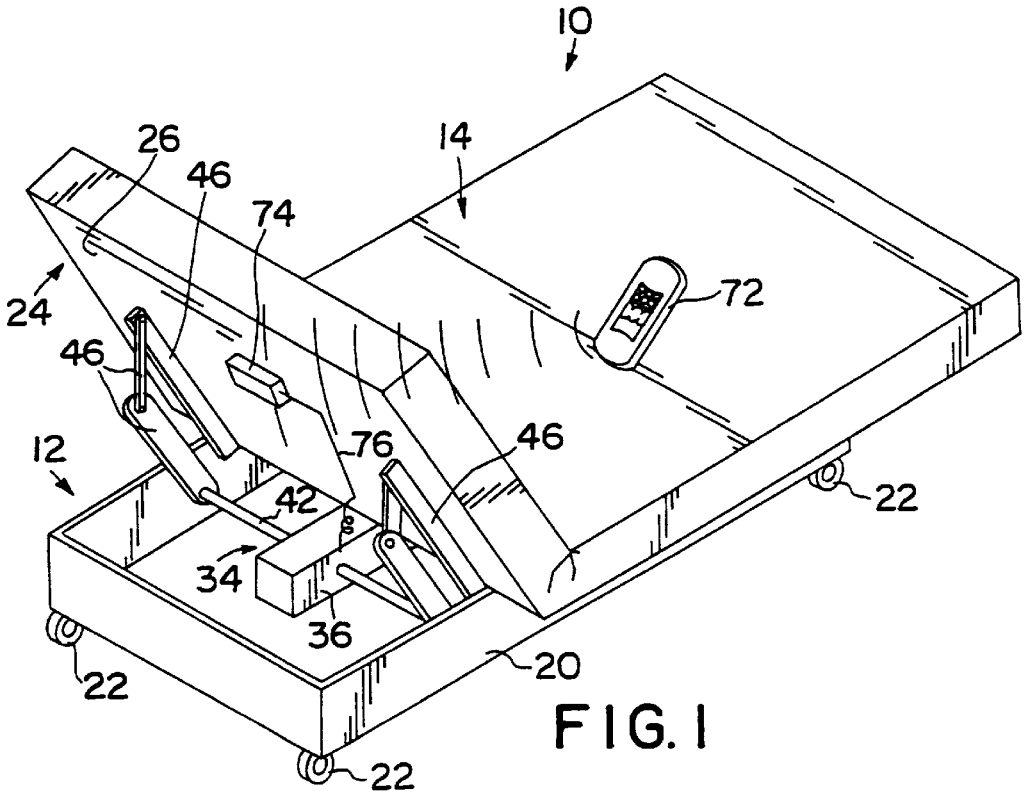
FIG. 1 is a perspective view of a bed assembly in accordance with the present invention showing a frame having an articulated section, a drive system operable to move the articulated section, a foam mattress supported by the frame, a receiver coupled to the frame, and a remote control unit which is used to transmit command signals through the receiver to the drive system to articulate the frame section.
Figure 2:
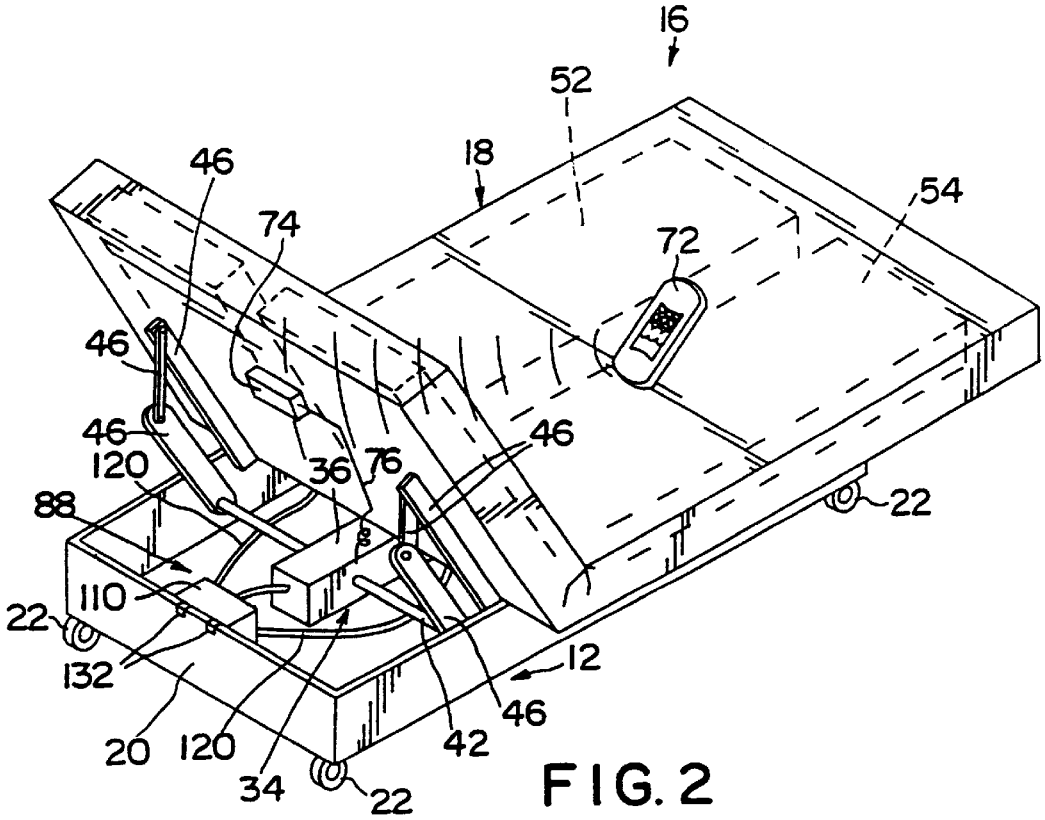
FIG. 2 is a perspective view of the bed assembly of FIG. 1 showing the foam mattress replaced by an air mattress having air bladders (in phantom), an air control module mounted to the frame, the air control module being coupled electrically to the drive system to receive command signals and line voltage power therefrom, and the air control module being coupled pneumatically to the air bladders to control the inflation and deflation thereof.

A first configuration bed assembly 10, which includes a frame 12 and a foam mattress 14 supported by frame 12 as shown in FIG. 1, is upgradable to a second configuration bed assembly 16, which includes frame 12 and an air mattress 18 supported by frame 12 as shown in FIG. 2. Frame 12 includes a rectangular base 20, a set of floor-engaging casters 22 extending downwardly from base 20, and an articulating deck 24 having head, seat, thigh, and foot frame sections 26, 28, 30, 32 as shown best in FIG. 3. Mattresses 14, 18 are each sized to fit onto articulating deck 24 as shown in FIGS. 1 and 2, respectively.

Figure 3:
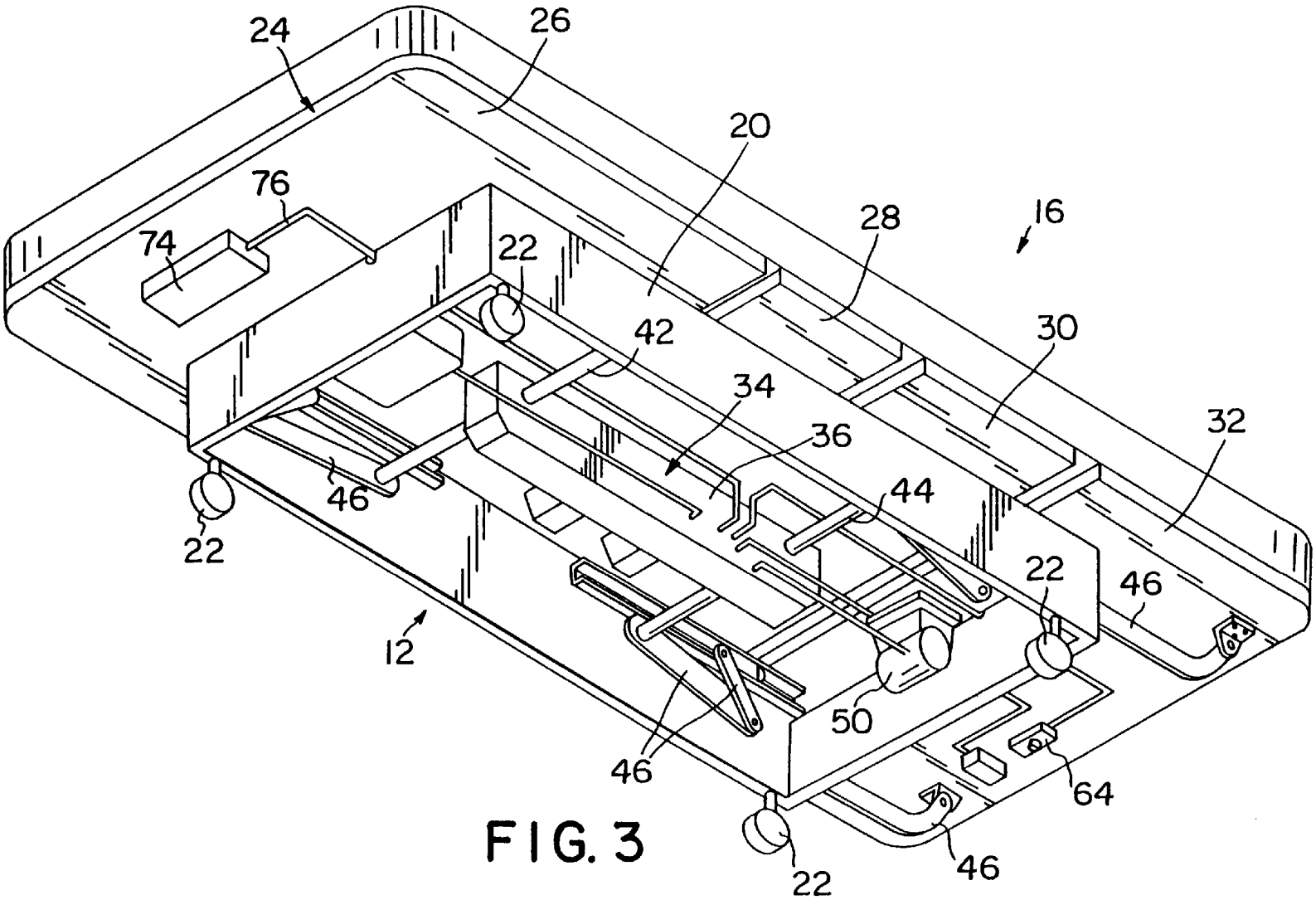
FIG. 3 is a perspective view of the underside of the bed assembly of FIG. 2.
Figure 4:
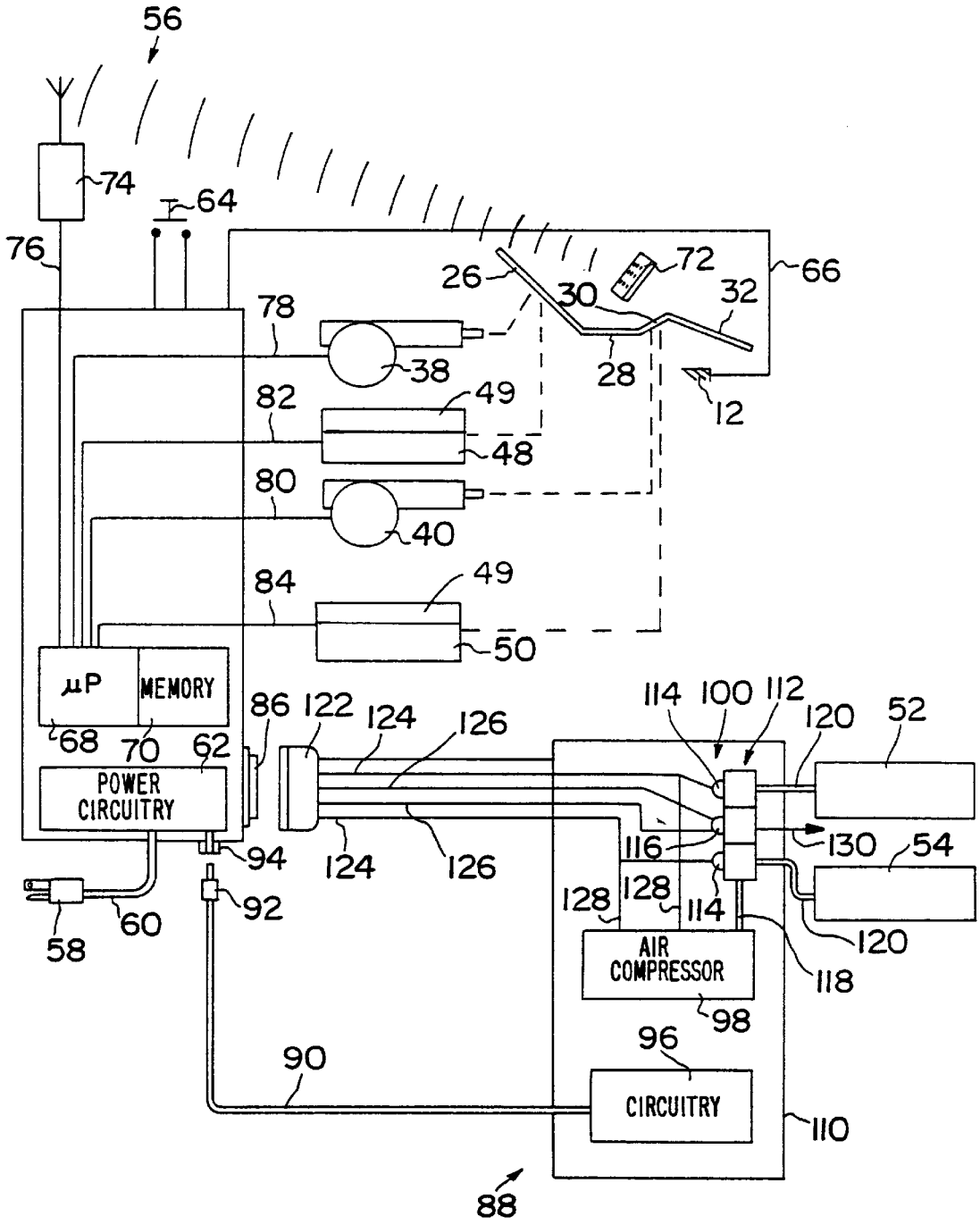
FIG. 4 is a block diagram of the bed assembly of FIG. 2 showing the drive system including a first electrical circuit being electrically coupled to the receiver, electrically coupled to first and second articulation motors, and electrically coupled to first and second massage motors and showing the drive system being coupleable electrically to the air control module, the air control module including a second electrical circuit that receives command signals from the first electrical circuit, a compressor, and a manifold and valve assembly that is coupled pneumatically to the air bladders.

Frame 12 includes a drive system 34 having a housing 36, shown in FIGS. 1–3, and first and second articulation actuators or motors 38, 40, shown diagrammatically in FIG. 4, that are situated inside housing 36. First motor 38 operates to articulate head section 26 relative to base 20 and second motor 40 operates to articulate thigh and foot sections 30, 32 relative to base 20. Thus, motors 38, 40 are operable to move articulating deck 24 so that either mattress 14 or mattress 18 is adjustable to a desired position.

In the illustrated embodiments of FIGS. 1–3, motors 38, 40 are coupled to first and second output shafts 42, 44, respectively, and frame 12 includes a set of links 46 that couple output shafts 42, 44 to the respective frame sections 26, 30. However, it will be understood by those skilled in the art that many different types of mechanical mechanisms and force-transmission elements may be used to articulate sections of a bed frame and thus, the mechanical connections between motors 38, 40 and respective frame sections 26, 30 are shown diagrammatically in FIG. 4 as dotted lines.

Frame 12 further includes a head-end massage motor 48 coupled to head section 26 and a foot-end massage motor 50 coupled to thigh section 30. Massage motors 48, 50 each include an eccentric weight 49, the rotation of which vibrates the associated head section 26 and thigh section 30, respectively. Although illustrative motors 48, 50 are mounted directly to respective frame sections 26, 30, it is within the scope of the invention as presently perceived for massage motors 48, 50 to transmit vibrations to frame sections 26, 30 through alternative mechanisms (not shown) and thus, each of the mechanical connections between motors 48, 50 and respective frame sections 26, 30 is shown diagrammatically in FIG. 4 as dotted line.

Air mattress 18 is illustratively a queen size mattress. Air mattress 18 includes a set of air bladders 52, 54 as shown in FIG. 2 (in phantom) and as shown diagrammatically in FIG. 4. Each of air bladders 52, 54 is separately inflatable and deflatable to control the firmness and support characteristics of the associated portion mattress 18. Mattress 18 further includes foam elements (not shown) that surround one or more sides of air bladders 52, 54. However, it is within the scope of the invention as presently perceived for mattresses with only air bladders or with air bladders and supporting structures other than foam elements to be included in bed assembly 16 instead of mattress 18.

Twin and full size mattresses (not shown) include only one air bladder. In addition, a king size mattress includes two twin mattresses located side by side. Therefore, each ½ king mattress section only includes one air bladder. Although the drawings and description are related to the queen mattress embodiment, other mattress configurations are within the scope of the present invention.

Frame 12 includes control circuitry 56 which generates signals to control motors 38, 40, 48, 50 and which generates signals to control the inflation and deflation of air bladders 52, 54. Control circuitry 56 includes a plug 58 that couples to an electrical outlet (not shown) to receive standard 110 V, 60 Hz AC electric power which is supplied through a power cord 60 to the other components of control circuitry 56. Control circuitry 56 further includes power circuitry 62 that converts the supplied AC power to power suitable for operating various circuit components of control circuitry 56.

Control circuitry 56 includes a power down switch 64 that is pressed to lower sections 26, 30, 32 to a flat, horizontal position when power supplied via plug 58 and power cord 60 is interrupted. In addition, control circuitry 56 includes a battery, capacitor, or other device (not shown) for storing electric potential to provide auxiliary power to motors 38, 40 so that sections 26, 30, 32 are lowered to the flat, horizontal position. Control circuitry 56 is grounded to frame 12 by a ground wire 66.

Control circuitry 56 includes a microprocessor 68 and memory 70 as shown diagrammatically in FIG. 4. In addition, control circuitry 56 includes other electrical components (not shown) that are well known to those skilled in the art and that supplement the operation of microprocessor 68 and memory 70. Examples of such other electrical components include a clock or oscillator, resistors, and relays.

A hand-held controller 72 is used to send command signals to control articulation of frame 12 and to control the inflation and deflation of air bladders 52, 54. One controller 72 is used for twin, full and each ½ king size beds. Two controllers 72 are used for queen size beds. In the illustrated embodiment, controller 72 is a wireless remote control unit and control circuitry 56 includes a receiver module 74 that receives the command signals from controller 72. However, it is within the scope of the invention as presently perceived for controller 72 to be coupled directly to control circuitry 56 by a wire.

Receiver module 74 is coupled to control circuitry 56 via a line 76. Command signals received by receiver module 74 from hand-held controller 72 are processed by microprocessor 68 and appropriate output signals are generated by microprocessor 68 to control articulation of frame 12 and to control inflation and deflation of air bladders 52, 54. A software program is stored in memory 70 and microprocessor 68 executes the software program to generate the output signals based upon the command signals.

Control circuitry 56 is coupled electrically via lines 78 to articulation motor 38, via lines 80 to articulation motor 40, via lines 82 to massage motor 48, and via lines 84 to massage motor 50. Some of the output signals generated by microprocessor 68 are communicated to motors 38, 40, 48, 50 via respective lines 78, 80, 82, 84 and some of the output signals generated by microprocessor 68 are communicated to an output connector 86. It should be understood that, although lines 76, 78, 80, 82, 84 are illustrated as being coupled directly to microprocessor 68, various other electrical components (not shown) may be included in each of lines 76, 78, 80, 82, 84.

When first configuration bed assembly 10 is converted to second configuration bed assembly 16, by replacing foam mattress 14 with air mattress 18, an air module 88 is coupled electrically to control circuitry 56 and is coupled pneumatically to air bladders 52, 54 of the queen size mattress as shown in FIGS. 2–4. Air module 88 includes a power coupling cable 90 having an end connector 92 that plugs into a power outlet 94 of control circuitry 56. Control circuitry 56 is configured so that some of the electric power received by control circuitry through plug 58 and power cord 60 is diverted to air module 88 through outlet 94, connector 92, and cable 90. Air module 88 includes driver circuitry 96 that uses the power received on cable 90 for operating the components of air module 88 via control signals from lines 124 and 126.

Figure 5:
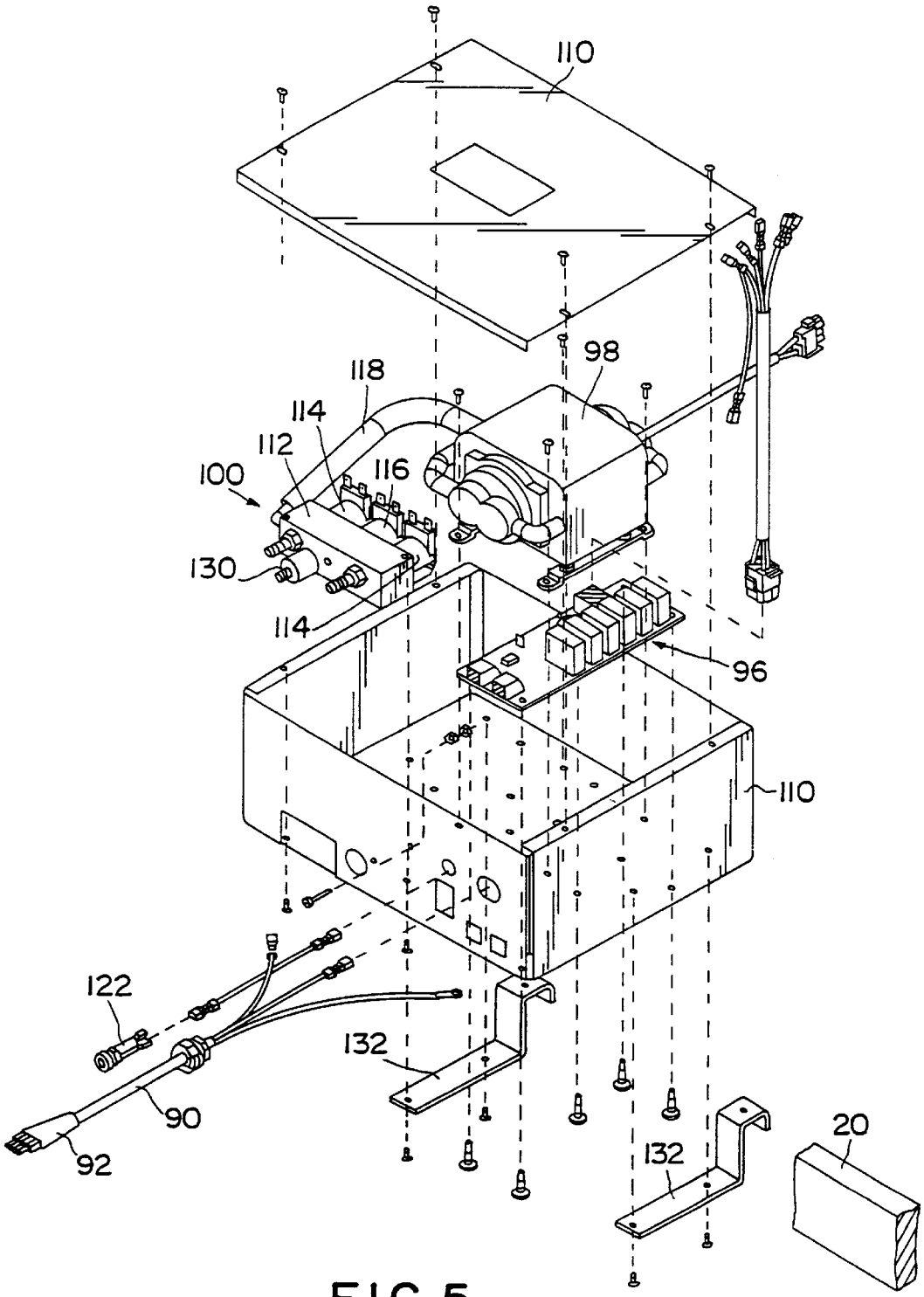
FIG. 5 is an exploded perspective view of the air control module of FIG. 4 showing a housing of the air control module having an interior region that receives the compressor, the manifold and valve assembly, and the second electrical circuit.

Air module 88 includes an air compressor 98 and a manifold and valve assembly 100 as shown diagrammatically in FIG. 4. Compressor 98 and manifold and valve assembly 100 are contained within a housing 110 of air module 88 as shown best in FIG. 5. Manifold and valve assembly 100 includes a manifold block 112, a pair of zone valves 114, and a vent valve 116 as shown in FIGS. 4 and 5. Manifold block 112 is formed to include internal passages (not shown), portions of which are opened and closed by zone valves 114 and by vent valve 116. Air compressor 98 is coupled pneumatically to vent valve 116 by a hose 118 and the internal passages of manifold block 112 are pneumatically coupled to air bladders 52, 54 of a queen mattress by respective pressure-control hoses 120. The pressure in each of air bladders 52, 54 is adjusted by operation of compressor 98 and by manipulation of the position of zone valves 114 and vent valve 116.

Air module 88 includes an electrical input connector 122, shown diagrammatically in FIG. 4, that couples to electrical output connector 86 of control circuitry 56 to receive command signals therefrom. Input connector 122 is coupled electrically via lines 124 to respective zone valves 114 and via lines 126 to vent valve 116. Two connectors 122 are provided for a king system as discussed below. In addition, each of lines 124 is coupled electrically to air compressor 98 via lines 128. The command signals for inflating and deflating air bladders 52, 54 of the queen mattress are transmitted from hand-held controller 72, through control circuitry 56 where they are processed by microprocessor 68, through output connector 86, and through input connector 122 to valves 114, 116 on respective lines 124, 126 to control opening and closing of valves 114, 116. In addition, compressor 98 is operated by signals received thereby on lines 128.

Each of valves 114, 116 are movable between respective opened positions and closed positions. When vent valve 116 is in the closed position, the internal passages of manifold block 112 are decoupled pneumatically from the atmosphere and when vent valve 116 is in the opened position, the internal passages of manifold block 112 are coupled pneumatically to the atmosphere. When air bladders 52, 54 are both at desired pressures, valves 114, 116 are all in the respective closed positions and compressor 98 is turned off. During inflation of either of air bladders 52, 54, the associated zone valve 114 is in the opened position, vent valve 116 is in the closed position, and compressor 98 is turned on to pump air from the atmosphere through hose 118, through the appropriate internal passages of manifold block 112, through the respective pressure-control hoses 120, and into the respective air bladder 52, 54 being inflated. During deflation of either of air bladders 52, 54, the associated valve 114 is in the opened position, compressor 98 is turned off, and vent valve 116 is in the opened position so that air from the respective air bladder 52, 54 being deflated bleeds through the respective pressure-control hoses 120, through the appropriate internal passages of manifold block 112, through vent valve 116, and through an exhaust or pressure relief valve 130 into the atmosphere.

Pressure relief valve 130 of the air system allows control of maximum pressure capability for the air bladders 52, 54. Commercially available compressors typically provide a pressure supply that is greater than the pressure required for adequate firmness in the mattress bladders. If the system is operated without the pressure relief valve 130, the response time to "soften" (reduce pressure) in the mattress is so long that a user typically cannot recognize that the mattress is softening. In other words, a user cannot typically detect a pressure difference when the pressure ranges from about 1.25 to about 3 psi. With the pressure relief valve 130, the response time is minimized because the maximum pressure of each mattress air bladder 52 or 54 is lower. Illustratively, the pressure relief valve 130 is set to vent pressure above about 1–1.25 psi. It is understood that other settings may be used for pressure relief valve 130, if desired.

Thus, according to the present invention, bed assembly 10 is upgraded to bed assembly 16 by removing foam mattress 14 from frame 12, placing air mattress 18 on frame 12, coupling air module 88 electrically to control circuitry 56, and coupling air module 88 pneumatically to air bladders 52, 54. By providing the software program stored in memory 70 with algorithms to control both the articulation of frame 12 and the inflation and deflation of air bladders 52, 54, the same hand-controller 72 that controls bed assembly 10 may be used to control bed assembly 16. In the illustrated embodiment, air module 88 includes a pair of brackets 132, shown best in FIG. 5, that are mounted to housing 110 and that are configured for attachment to rectangular base 20 of frame 12.

As discussed above, for twin and full size bed configurations, only a single air bladder 52 is used. Therefore, only one zone valve 114 and vent valve 116 shown in FIGS. 4 and 5 are required for the twin and full size mattresses. The king size bed is divided into two twin size sections having one bladder 52 or 54 in each twin mattress section. The king control system is illustratively a master/slave configuration. Separate control circuitry 56 is provided for both the master and slave beds. A single air module 88 is used for both the king master and slave beds. An additional connector 122 is provided on the air module 88 for connecting the control circuitry 56 of both the master bed and the slave bed to the housing 110 of the air module 88.

Although the invention has been described in detail with reference to certain preferred embodiments, variations and modifications exist within the scope and spirit of the invention as described and defined in the following claims.

What is claimed is:

1. A bed assembly comprising a frame having at least one articulated frame section, an actuator coupled to the articulated frame section, the actuator being operable to move the articulated frame section, a drive control module coupled to the actuator, the drive control module including a first electrical circuit and a remote control unit, the remote control unit sending command signals to the first electrical circuit, and the first electrical circuit sending a drive signal to operate the actuator to move the articulated frame section in response to a first command signal received from the remote control unit, the drive control module including an output connector coupled to the first electrical circuit, a mattress supported by the articulated frame section and having at least one air bladder, and an air control module including a compressor fluidly coupled to the at least one air bladder, the air control module including a second electrical circuit and an electrical input connector that plugs into the electrical output connector of the drive control module, the electrical input connector being coupled to the second electrical circuit, the first electrical circuit sending an air command signal through the output connector and through the input connector to the second electrical circuit to operate the compressor to adjust pressure of the at least one air bladder in response to a second command signal received from the remote control by the first electrical circuit.

2. The bed assembly of claim 1, the drive control module includes a receiver coupled to the frame, the remote control unit includes a transmitter that sends signals to the receiver, the receiver is coupled electrically to the first electrical circuit, and the receiver is coupled electrically to the second electrical circuit through the first electrical circuit.

3. The bed assembly of claim 1, wherein the drive control module includes an electrical conductor extending between the remote control unit and the first electrical circuit whereby the remote control unit is coupled electrically to the second electrical circuit through the electrical conductor via the first electrical circuit.

4. The bed assembly of claim 1, wherein the first electrical circuit includes a microprocessor that processes the command signals received from the remote control unit and the microprocessor generates the air command signal.

5. The bed assembly of claim 4, wherein the air control module includes a valve and the microprocessor generates a valve-control signal that controls operation of the valve.

6. A bed assembly for use by a user, the bed assembly comprising:

a frame having at least one articulated frame section;

an actuator coupled to the articulated frame section and being operable to move the articulated frame section;

a mattress supported by the articulated frame section and having at least one air bladder;

control circuitry including a drive control module operably coupled to the actuator, wherein the control module operates the actuator to move the articulated frame section in response to a command from the user;

and an air control module movable between a first position spaced apart from and decoupled from the drive control module and a second position operably coupled to the air bladder and directly coupled to the drive control module, whereby the air control module can adjust air pressure of the bladder in response to a command from the user.

7. A kit for upgrading a mattress carried on a bed assembly with a frame having at least one articulated frame section and an actuator coupled to the articulating frame section to move the articulating frame section through a control circuit including a drive control module coupled to the actuator and a remote control unit for sending a drive signal to operate the actuator to move the articulated frame section in response to a first command signal from the remote control unit, the kit comprising:

a bladder received by the mattress when the bladder is installed in the bed assembly;

an air module directly coupled to the drive control module when the air module is installed in the bed assembly, the air module including a compressor in fluid communication with the bladder when the bladder and the air module are installed in the bed assembly;

and an electrical circuit coupled to the compressor and to the drive control module when the air module is installed in the bed assembly to operate the compressor to adjust air pressure in the bladder in response to a second command signal from the remote control unit.

8. A bed assembly for use by a user, the bed assembly comprising:

a frame, a first actuator operably coupled to the frame, a mattress carried by the frame, a second actuator operably coupled to the mattress, a remote control unit, a first electrical circuit coupled to the first actuator, wherein the remote control unit sends a command signal to the first electrical circuit in response to a command from the user, the first electrical circuit sending a first drive signal to operate the first actuator in response to the command signal;

an electrical output connector coupled to the first electrical circuit;

an electrical input connector;

a second electrical circuit coupled to the electrical input connector, wherein the electrical input connector is movable between a first position spaced apart from the electrical output connector and a second position in which the electrical input connector is directly coupled to the electrical output connector to connect the first electrical circuit to the second electrical circuit, and wherein the second electrical circuit is coupled to the second actuator for sending a second drive signal thereto to operate the second actuator in response to a second command signal from the remote control unit when the electrical input connector is in the second position.

9. The bed assembly of claim 8, wherein the remote control unit sends the second command signal through the first electrical circuit, through the electrical output connector and through the electrical input connector to the second electrical circuit when the electrical input connector, is in the second position.

10. The bed assembly of claim 8, wherein the frame has at least one articulated frame section and wherein the first actuator is coupled to the articulated frame section to move the articulated frame section in response to the first drive signal.

11. The bed assembly of claim 8, further comprising an eccentric weight operably coupled to the frame and a motor coupled to rotate the weight and thereby vibrate the frame in response to the first drive signal.

12. The bed assembly of claim 8, further comprising an eccentric weight operably coupled to the mattress and a motor coupled to the weight to rotate the weight and thereby vibrate the mattress in response to the second drive signal.

13. The bed assembly of claim 8, wherein the mattress includes at least one bladder and a compressor in fluid communication with the at least one bladder to adjust the pressure of air in the at least one bladder, in response to the second drive signal.

14. The bed assembly of claim 13, further comprising an air supply in fluid communication with the at least one bladder and a manifold and valve assembly positioned to lie between the air supply and the at least one bladder.

15. The bed assembly of claim 14, wherein the manifold and valve assembly includes a zone valve movable between a closed position blocking the flow of air between the air supply and the at least one bladder and an open position permitting the flow of air between the air supply and the at least one bladder.

16. The bed assembly of claim 14, wherein the manifold and valve assembly includes an exhaust in fluid communication with the at least one bladder and in fluid communication with the atmosphere, a vent valve positioned to lie between the at least one bladder and the exhaust, and wherein the vent valve is movable between a closed position blocking the flow of air between the at least one bladder and the exhaust and an open position permitting the flow of air between the at least one bladder and the exhaust.

* * * * *